US005296257A

United States Patent [19]

Knop et al.

[11] Patent Number: 5,296,257

[45] Date of Patent: Mar. 22, 1994

[54] PROCESS FOR TWO-SIDED COATING OF A WEB

[75] Inventors: Reinhard Knop, Bochum; Volker Fathke, Wuppertal, both of Fed. Rep. of Germany

[73] Assignee: Jagenberg Aktiengesellschaft, Dusseldorf, Fed. Rep. of Germany

[21] Appl. No.: 96,019

[22] Filed: Jul. 22, 1993

Related U.S. Application Data

[63] Continuation-in-part of Ser. No. 781,350, Oct. 22, 1991.

[30] Foreign Application Priority Data

Oct. 22, 1990 [DE] Fed. Rep. of Germany ..... 4033521

[51] Int. Cl.[5] ..... B05D 1/28

[52] U.S. Cl. ..... 427/10; 427/211; 427/428; 427/557; 427/561; 427/595

[58] Field of Search ..... 427/10, 557, 561, 595, 427/428, 211

*Primary Examiner*—Bernard Pianalto

*Attorney, Agent, or Firm*—Herbert Dubno

[57] ABSTRACT

In the two-sided coating of a web by feeding the web through the nip of a pair of pressing rolls onto which the coating substance is metered, the amount of the coating substance applied to each pressing roll is measured by infrared absorption and the relative coating quantities $RW_o$ onto the upper side and $RW_u$ to the underside are calculated by the relations $$RW_o = M2_o/(M2_o + M2_u) \text{ and}$$

$$RW_u = M2_u/(M2_o + M2_u); \text{ and}$$

where $M2_o$ represents an infrared absorption measurement of the coating on the roll applying the coating to the upper side and M2u represents the absorption measurement of the coating on the roll applying the substance to the underside of the web.

4 Claims, 2 Drawing Sheets

PROCESS FOR TWO-SIDED COATING OF A WEB

CROSS REFERENCE TO RELATED APPLICATION

This application is a continuation-in-part of our copending application Ser. No. 07/781,350 filed Oct. 22, 1991 and entitled, "APPARATUS FOR TWO-SIDED COATING OF WEBS."

FIELD OF THE INVENTION

Our present invention relates to a process for the two-sided coating of a web and especially a web of a paper, paper-board or cardboard.

BACKGROUND OF THE INVENTION

An apparatus for the two-sided coating of a web of paper or cardboard can comprise two juxtaposed pressing rollers defining a pressing gap or nip between them through which the web can pass. An applicator and metering system can be provided for each of these rollers, upstream of the nip with respect to the direction of rotation of the roller to apply to the roller a layer of a material, usually a liquid or other flexible substance, transferred to the web at the nip.

Such apparatus can be employed for the two-sided coating of glue or sizing (starch, carboxymethylcellulose-CMC, synthetic size or glue) or pigment dispersions onto paper or cardboard webs.

The purpose of the applicator and metering or dosing system assigned to each roller is the application to the respective roller of a film of the coating material in a metered amount.

An apparatus of this type is described in the German Utility Model 84 14 413.

In this system, the applicator and metering unit includes a nozzle chamber open toward the respective pressing roller, and at a downstream side of this chamber, a metering element which is pressed against the pressing roller and which closes the nozzle chamber.

The metering elements which can be used can include a doctor bar formed with peripheral grooves or flutes and fabricated, for example, by adjacent turns of wire on a support. The amount of the flowable substance which is applied to the pressing roller is then determined by the groove cross-section where the doctor bar is applied forceably against the surface of the pressing roller.

Other known metering elements include doctor bars with smooth surfaces, shaver blades or shaver strips and, in general, doctor blades.

In these systems, the coating weight applied to the surface of the pressing roller, i.e. the weight of material per unit area, can be varied by varying the pressing force with which the doctor bar or doctor blade is urged toward the pressing roller.

It is known to measure the quantity of the coating substance applied to a web continuously and directly upon the web. For this purpose, radioactively-emitting elements may be provided and the absorption of the radioactive radiation through the web can indicate the coating weight (quantity in weight units per unit area) and/or the moisture of the coating applied to the web which, in turn, can be correlated with the quantity of coating applied per unit area and, for a given and known substance, the thickness thereof or the amount of the substance coated onto or penetrating into the web.

For adjustment and/or monitoring of the coating weight, separately for each side, complex measuring devices must be provided and juxtaposed with each side of the web directly and, as experience has shown, can provide with any accuracy only the total quantity of coating material applied by the two-sided coating without any significant possibility of accurately indicating the quantity applied to each side.

Mention may also be made of U.S. Pat. No. 4,957,770 which provides a sensor and a method for determining the basis weight, i.e. the weight per unit area, of coating material on a substrate.

The infrared sensor of this apparatus determines the amount of a coating material on a substrate using measurements of infrared radiation reflected from the substrate or the transmission of infrared radiation through the substrate. This system employs at least two separate weavelength regions of the infrared.

More particularly, the infrared coating sensor includes a source of infrared radiation, a beam of which is transmitted toward the moving sheet. When the beam reaches the sheet, it first passes through the coating material and then into the base paper sheet. A portion of the energy is transmitted through the sheet. Some of the infrared energy, after entering the base sheet, is reflected back in the general direction of the source. It is recognized in this reference that infrared radiation is preferentially absorbed by the coating and/or the base sheet itself.

Notwithstanding the ability to utilize infrared measurements to determine the coating on the sheet, the sensor and the use of it in this patent do not assure extremely precise applications of the coating substances to both sides of a web of paper or paper board.

OBJECTS OF THE INVENTION

It is, therefore, the principal object of the present invention to provide an important process for the two-sided coating of a web of paper, paper board or cardboard, whereby drawbacks of earlier systems are obviated.

It is another object of the invention to provide a process for the purposes described whereby the coating is applied with considerable accuracy to each side of the web and it is possible to determine with precision the basis weight or weight per unit area of the coating thus applied.

Another object of our invention is to provide an improved two-sided coating method or process which extends the principles set forth in the copending application identified above.

SUMMARY OF THE INVENTION

In the earlier application of which this application is a continuation-in-part, we disclose a two-sided coating system having, as noted, a pair of pressing rollers juxtaposed with opposite sides of a web to be coated and which is fed through a nip defined by those rollers, and an applicator and metering system applying respective quantities of a flowable substance to the respective pressing rollers at locations spaced from the nip or pressing gap and, described in the earlier invention, at each of the pressing rollers at a location in the direction of rotation thereof downstream from the respective application and metering system but upstream of the pressing gap of the nip, a respective measuring device for the continuous measurement of the respective quantity of coating material applied to the respective roller.

As described in the earlier invention, therefore, rather than measure the quantity of the flowable substance applied to the web directly upon the web, the invention measures the quantity of the coating substance forming the film on the respective pressing roller before that film is transferred to the web. This enables a quantitative determination of the coating material applied by each application of metering system to the web through the intermediary of the respective pressing roller.

A further advantage is that, where use of the metering element results in wear thereof, for example in the case of a wire-wound doctor bar, the system of the invention can provide monitoring of the wear by monitoring of the amount of material applied to the web, to permit replacement of the metering element in a timely manner. Because of this wear, the quantity of material applied by the respective doctor bar to the respective pressing roller will be altered and, with the invention, when the applied quantity on the pressing roller reaches a certain maximum or minimum limiting level, the replacement of the metering element can be triggered so that damage to the roll surface, for example by wire breakage, the production of defective product, etc. can be avoided.

As described in the earlier application, a further measuring device is provided downstream of the nip of the pressing rollers and upstream of each applicator and metering device for each pressing roller to monitor the amount of material left thereon as the surface of that pressing roller moves away from the nip.

From the difference in the measurements upstream and downstream of the nip, we are able to determine with great precision the quantity of the flowable substance which is transferred from the pressing roller to the web.

In still another feature of the invention, the measuring devices are devices which respond to the quantity of water in the coating material applied to the pressing rollers and the web.

The ability to make a precise determination of the coating material picked up by the web is especially important in the coating of paper or cardboard where the amount supplied cannot exactly be predetermined at the applicator.

The fact that the determination is made on water, allows a variety of measuring instruments to be employed for the purpose. Generally such measurements reflect accurately the total quantity of material applied to the pressing rollers since the compositions of the coating substances is determined with accuracy in the preparation thereof.

According to still another feature of the invention, the measuring devices operate by monitoring infrared absorption of the coating substances. They utilize the fact that molecular bonds, for example OH and CH, absorb light energies with exactly defined wavelengths. The measuring devices, therefore, can include halogen lamps which transmit light beams onto the surface to be monitored, i.e. the coated pressing roll surface, and the reflected radiation can be collected and its frequency and/or amplitude evaluated. In this manner we are able to directly measure the quantity of the substance on the surface of the roller, and using appropriate calibration, the fraction picked up by the web in terms of water or solids.

According to the present invention, the above-mentioned principles are utilized but the process by which the coating is controlled is improved. The process comprises the steps of:

(a) feeding the web through a nip of a pair of pressing rolls;

(b) metering onto each of the pressing rolls before the respective pressing roll meets the web, a controlled quantity of a coating substance, thereby transferring the substance to the web on a respective side thereof;

(c) measuring by infrared absorption a respective quantity of the coating substance on each of the rolls at a respective location of the roll upstream of the transfer of the substance to the web by the respective roll, thereby obtaining a value $M2_o$ for an absorption measurement on the roll applying the substance to and upperside of the web and a value $M2_u$ for an absorption measurement on the roll applying the substance to the underside of the web;

(d) determining values of a web upperside relative coating quantity $RW_o$ and a web underside relative coating quantity $RW_u$ based upon the relations:

$$RW_o = M2_o/(M2_o + M2_u) \text{ and}$$

$$RW_u = M2_u/(M2_o + M2_u); \text{ and}$$

(e) automatically controlling the application of the substance to each of the rolls in response to the respective values $RW_o$ and $RW_u$.

According to a feature of the invention the amounts of the substance on the opposite side of the web can be determined by the steps of:

measuring a total quantity CW of the substance applied to the web by the rolls; and determining the amounts $CW_o$ and $CW_u$ applied to the upperside and the underside, respectively, of the web from the relations:

$$CW_o = RW_o \cdot CW \text{ and}$$

$$CW_u = RW_u \cdot CW.$$

The quantity CW can be measured by obtaining a difference in measurement of the weights per unit area (basis weights) of the web prior to and subsequent to coating.

When an infrared absorption measurement of the substances remaining upon each roll downstream of the nip is effected in addition, we are able to establish with precision by a difference between infrared absorption measurements on each roll upstream and downstream of the nip, the amount which has been transferred to the underside and up-side of the web respectively.

The advantage of the present invention over the system described, for example in U.S. Pat. No. 4,957,770, is that while this document describes the measurement of the total amount of coating material applied to the web continuously, the system cannot be used for regulating the individual quantities of the substance applied to each side, inasmuch as the measurement cannot distinguish between the coatings applied to each side independently of one another when the infrared technique is used directly on the web downstream of the coating location.

The process of the present invention thus enables, for the first time, automatic control of the coating profile in the longitudinal direction upon the coating of paper or cardboard.

As indicated, even the absolute quantity of the coating substance can be determined for each side. The difference measurements may be taken by a weighting technique or through measurements by absorption of radioactivity radiation.

The second infrared absorption measurement on each roll downstream of the nip allows a very precise determination of the material picked up on each side by the web, the second or downstream measurement being taken before the roll is recoated by the substance. This is especially advantageous in the coating of paper and cardboard when the transfer from a pressing roll to the web is not fully predictable, always reliable or reproducible.

The measurement systems of the invention, utilizing infrared absorption, utilized the effect that the molecular bond in compounds, for example the OH and the CH bonds, absorb light energy at very precissely defined wavelengths. A light beam is directed from a halogen lamp onto the surface on which the coating substance is to be measured, i.e. the pressing roll surface, and the reflected radiation is collected and measured. The difference between the incident and reflected measurements give the absorption which is a function of the amount of the substance. In this manner we are able to measure directly the amount of the substance applied to each of the pressing rolls and, by appropriate calibration as to take-up by the web of the water and solids components of the coating, we are able to determine the amount applied to the upper side and underside of the web respectively.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 2:
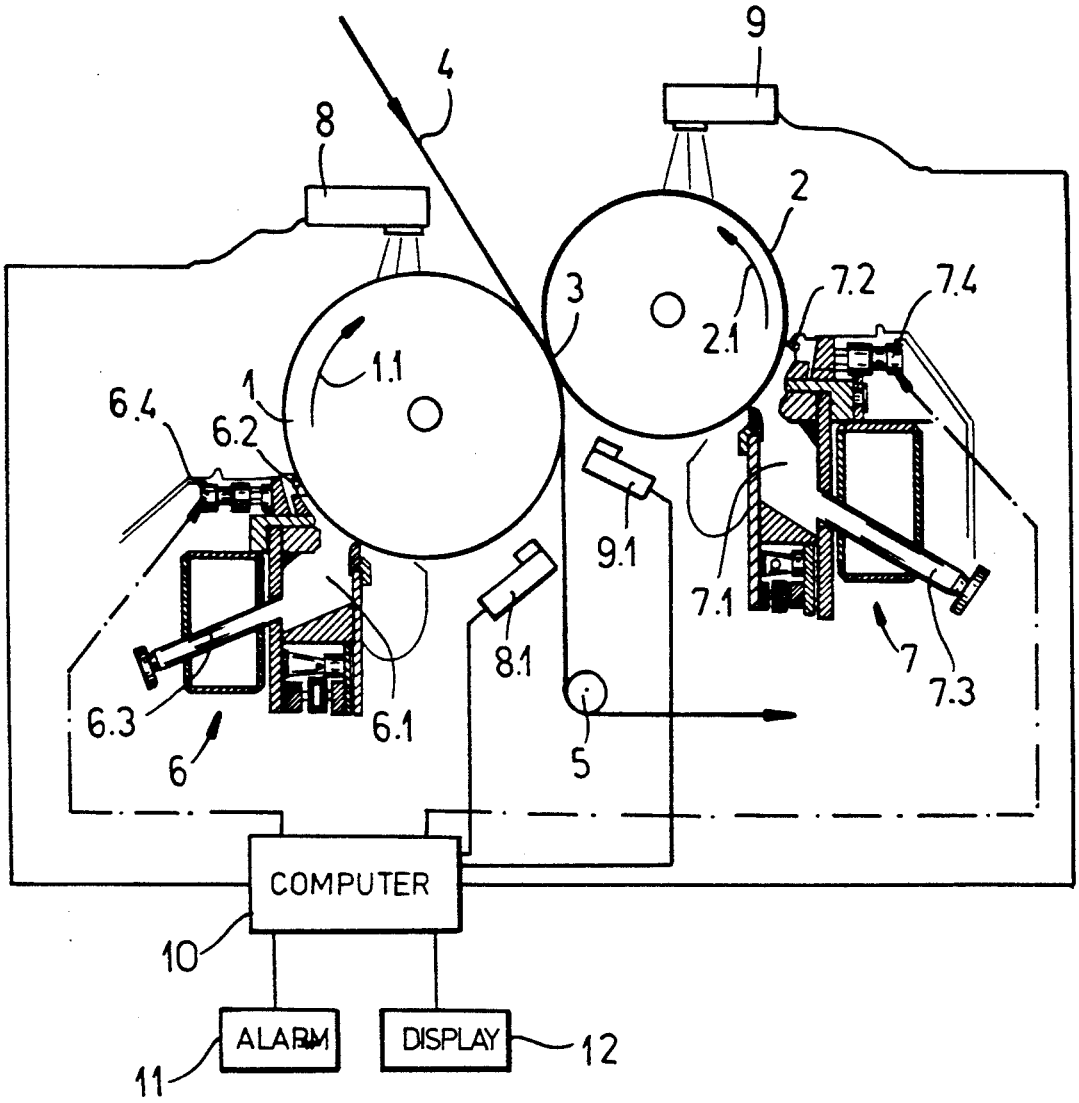
FIG. 2 is a highly diagrammatic side elevational view of a coating apparatus according to the invention, partly in section and with the parts thereof reversed in orientation with respect to the corresponding parts shown in FIG. 1.

Referring first to FIG. 2, we show a coating device of the type which is generally integrated in a paper-making machine and can be used for applying pigment sizing compositions to the paper or cardboard web which is formed therein.

The coating apparatus comprises two identical pressing rollers 1, 2 defining a pressing gap or nip 3 between them and through which a paper web 4 to be coated passes.

The paper web 4 is fed to the nip 3 from above so that it is partly slung around one of the pressing rollers 1, 2, in this case the pressing roller 1. Below the pressing rollers 1 and 2 is a guide roller 5 around which the paper web passes after leaving the nip to a drying unit of the paper-making machine.

The pressing rollers 1 and 2 have rubberized surfaces. Outside the region of the pressing gap or nip 3, each of the pressing rollers 1, 2 is juxtaposed with an applicator and metering unit 6, 7 which is located in a region of the respective pressing roller 1, 2 at which the pressing roller is not looped by the web 4.

Each applicator and metering unit 6, 7 comprises an applicator chamber 6.1, 7.1 to which the coating material can be fed under pressure through a supply system represented only diagrammatically at 6.3, 7.3, and which is closed at the downstream side of the chamber with respect to the direction of rotation of the rollers 1, 2 as represented by the arrows 1.1 and 2.1 by a respective metering or dosing element 6.2, 7.2.

The metering or dosing elements 6.2, 7.2 can remove excess material applied by the respective chambers to the pressing rollers 1, 2 so that only the desired film thickness of the coating substance remains on the surface of the pressing roller. The dosing element is preferably a doctor bar as described which has a structured surface, i.e. a surface provided with rises and recesses, for volumetric metering of the substance onto the surface of the respective roller. As noted, such doctor bars are known in the art and can comprise peripherally-grooved bars formed, for example, by winding wire in tightly adjacent turns upon a support.

Alternatively, the metering element can be a doctor bar with a smooth surface, a doctor blade or a doctor strip. Means as represented, for example, at 6.4 and 7.4 in the form of a fluid-operated cylinder can be used to control the pressure of the doctor member against the roller 1, 2.

Juxtaposed with each pressing roller 1, 2, in the direction of rotation downstream of the respective applicator and metering device 6, 7 and upstream of the nip 3 in the respective direction of rotation of each pressing roller, is a measuring device 8, 9 for the continuous determination of the quantity of the coating substance applied to the surface of the pressing roller 1, 2. The measuring device is preferably of the type operating by absorption of infrared radiation. In such measuring systems, infrared light from a halogen lamp is directed onto the surface of the pressing roller 1 or 2 through filters selecting the spectrum of the incident light. The reflected radiation is collected by a concave receiver or mirror and cast upon a photocell or other photo detector.

Preferably the filters select infrared radiation from the spectrum at which the wavelengths are absorbed by OH compounds. In this manner, using the detectors, we are able to determine with a high degree of accuracy the water component of the coating material applied to the surface quantitatively.

The coating material is transferred at the nip 3 to the web 4. The amount of solids can be correlated by the computer 10 with the measured water on the pressing roller surface from the known composition of the substance which can be inputted to the computer 10.

From calibrations recorded in the computer, the different amounts of the coating substance applied to the pressing rollers 1, 2 can be continuously applied to a display 12. Calibration can be effected by removing the coating from the surface after a calibration measurement of the infrared absorption and weighing or utilizing another moisture determination technique.

The calibration curves can be programmed into the computer so that the output on the display can directly indicate the quantity of coating material applied to each side of the web and, of course, to each of the rollers.

For a more precise indication of the quantities of coating material applied to the web, according to the invention, additional measuring devices 8.1 and 9.1 can be provided downstream of the nip and upstream of the respective applicator and metering unit 6, 7, so that the computer 10 can register differences between the measured values from the two measuring devices of each roller. In this manner, the residual coating substance on the pressing roller can be subtracted from the amount of coating substance on the pressing roller upstream of the nip to yield an actual value of the amount of coating substance transferred to the web.

The measuring devices thus permit determination of the amounts of coating material applied by each of the coating units 6, 7 to the respective sides of the web and facilitates uniform coating on both sides, for example, in the coating of pigments onto paper. It also permits monitoring of the wear of the doctor bar or other metering elements and an alarm 11 can be connected to the computer to signal the need for replacement of a metering element should the amount of the coating substance increase or decrease to a critical level indicating the need for such replacement. In the case of structured doctor blades, the wear is reflected in a reduction in the amount of coating material deposited on the surface and hence on the web as a result of reduction in the cross section of the grooves. In this case, the alarm will signal a reduction in the coating quantity indicative of such wear.

For smooth doctor blades, wear may increase the amount of material deposited upon the pressing roller and web. The system allows, therefore, replacement before wear damage can occur and consequent damage to the surface of the pressing roller. The computer may generally, in the case of smooth-surface or smooth-edge doctor elements, control the pressure elements 6.4 and 7.4 to regulate the amount of coating material applied to the respective rollers 1, 2, if desired.

Figure 1:
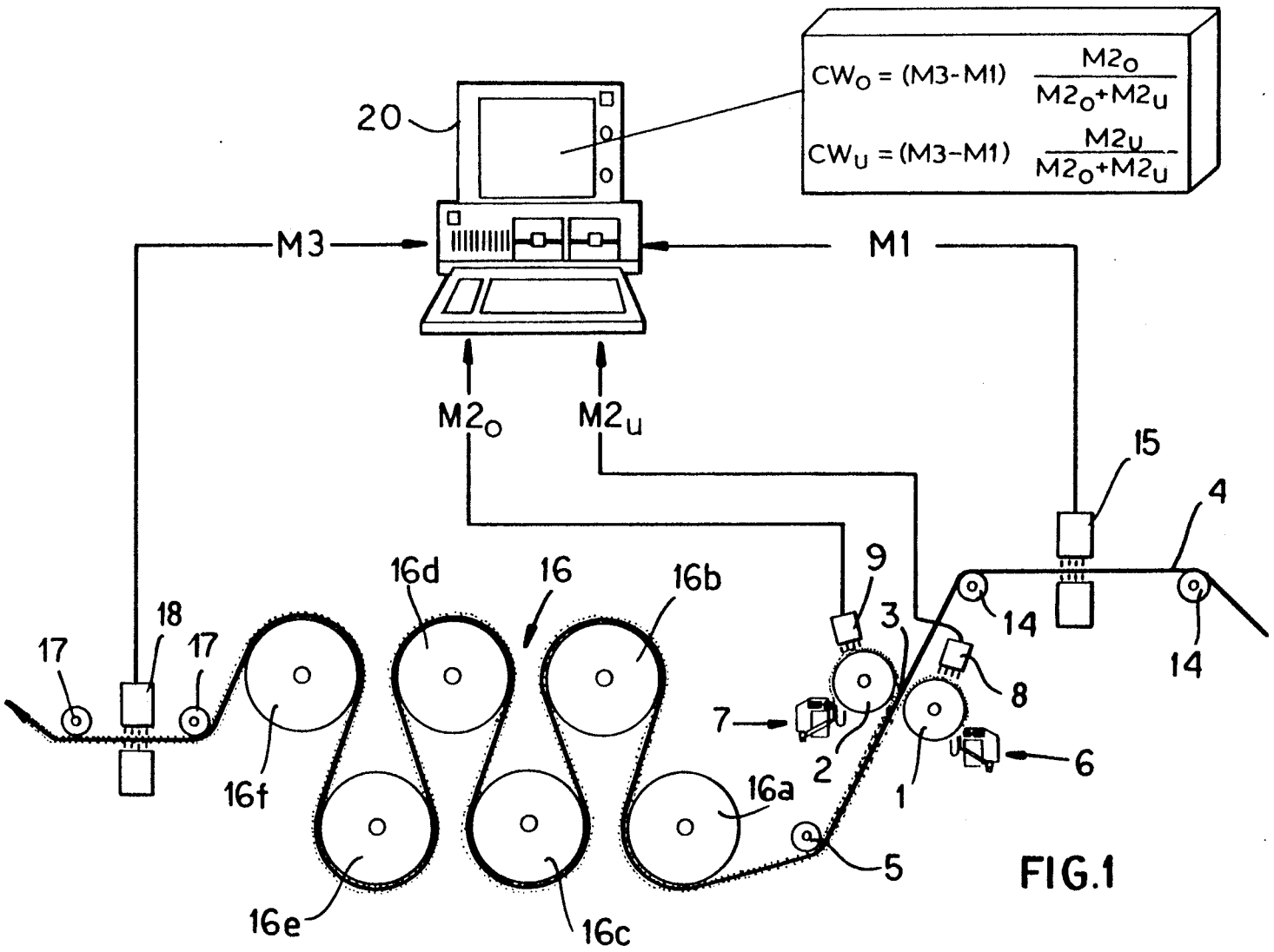
FIG. 1 is a diagram illustrating the means for carrying out the process of the invention.

In FIG. 1, the positions of the pressing rolls 1 and 2 are reversed with respect to FIG. 2, and a corresponding nip 3 is provided between the pressing rolls for the paper web 4. The latter is fed across a pair of idler rollers 14 through a region scanned by the rotation measurement unit 15 which, like the system described in the above-mentioned U.S. patent, for example, can measure the basis weight of the web 4 upstream of the coating location.

Here the web 4, after coating, passes under the guide roller 5 to a drying unit 16 made up of drying drums 16*a*, 16*b*, 16*c*, 16*d*, 16*e* and 16*f*, over which the web is looped and in which the web can be contacted by hot air.

From the drying unit 10, the web can be passed under guide roller 17 through another radiation measurement unit 18 which measures the basis weight of the fully-coated web.

In this construction, moreover, the pressing rolls 1, 2 are rubberized on their peripheries.

Outside the region of the nip 3, an application and metering system 6 is provided for the pressing roll 1 and a metering system 7 is provided for the pressing roll 2 outside regions in which the web is looped around any roller. As has been described in connection with FIG. 2, each of the application and metering systems 6, 7 has an application chamber 6.1, 7.1 open in the direction of the respective roll 1, 2 and to which the coating substance is fed under pressure.

Each of the coating chambers 6.1, 7.1 is closed with a metering element 6.2, 7.2 (FIG. 2) which strips off all of the coating substance except the desired film thickness thereof from the respective roll 1, 2.

The measuring system 11, which provides the basis weight of the not yet coated web 4 as an input M1 to computer 20 is used in conjunction with the measuring system 12 which provides the input M3 as a measure of the basis weight of the fully coated and dried web to the computer 20. Both measurements operate by absorption of radioactivity radiation.

As has been described in connection with FIG. 2, each of the pressing rolls 1, 2 is provided downstream of the respective application and metering systems 6 and 7 in the sense of radiation of the pressing roll and upstream of the pressing gap or nip 3 with a measuring device 8, 9 for the continuous measurement of the amount of coating material which has been applied to the pressing roll 1 or 2.

These measuring devices 8, 9 operate by absorption of infrared radiation. In such measuring systems infrared radiation is generated by a halogen lamp, the projected spectrum is subjected to selection by filtering and an infrared band of the appropriate frequency to be absorbed by a component of the coating substance is projected onto the coating. The reflected radiation is collected by a concave collector and measured.

Preferably the projected infrared radiation contains a wavelength which is absorbed by the OH bond so that the absorption is indicative of the amount of substance corresponding to a quantity of compounds containing the OH group. The water quantity deposited as part of the coating on the pressing roll can thus be quantitatively determined. The proportion of solids can be calculated from the composition of the coating material.

To determine the amount of material picked up by the web 4 from the respective pressing roll, the device can be calibrated at the beginning. For this purpose, different quantities with the same proportions of water and solid material can be applied to the pressing roll 1, 2 and the amount thus transferred to the web can be measured, e.g. by a weighing or a moisture measurement directly on the web.

With the thus obtained calibration curve, during operation, the amount picked up by the web can be calculated from the amount on the roll surface directly.

The measured value $M2_o$ from the measuring device 9 responsive to the substance on the pressing roll coating the upper side of the web and the measured value $M2_u$ from the measuring device 8 responsive to the coating substance on pressing roll 1 applying this substance to the underside of the web are continuously fed to the computer 20 and the output of the computer controls the metering systems 6 and 7 directly.

The computer 20 calculates the relative amount of the coating material which has been transferred from each pressing roll 1, 2 to the web in accordance with the relationships $$RW_o = M2_o/(M2_o + M2_u) \text{ and}$$

$$RW_u = M2_u/(M2_o + M2_u); \text{ and}$$

where $RW_o$ is the relative coating material quantity transferred to the upper side of the web and $RW_u$, the relative quantity of the coating substance transferred to the underside of the web. With these relative coating material quantities, the computer 20 provides a constant ratio of the coatings on the two sides of the web.

To measure the absolute quantity of the coating material applied by both pressing rolls 1, 2 to the web, the total amount CW is determined. Preferably the total amount CW is determined by a difference measurement between the basis weights of the web 4 before and after coating.

Downstream of the drier 16, therefore, the measuring device 12 determines the basis weight M3 of the coated web 4 and the measuring device 11 determines the basis weight M1 of the uncoated web 4. The computer 20 calculates the relationship CW=M3−M1 and the absolute quantities $CW_o$ of the coating on the upper side applied from roll 2 and $CW_u$ applied to the underside by the pressing roll 1 are calculated by the relations $$CW_o = RW_o \cdot CW \text{ and}$$

$$CW_u = RW_u \cdot CW.$$

It is possible, therefore, to determine exactly the amount of the coating material applied by each pressing roll to the web even when a certain amount of the coating material penetrates into the web and cannot be determined in a total measure to belong to either side. It is thus possible to generate a CW=M3−M1 and the absolute quantities $CW_o$ of the coating on the upper side applied from roll 2 and $CW_u$ applied to the underside by the pressing roll 1 are calculated by the relations $$CW_o = RW_o \cdot CW \text{ and}$$

$$CW_u = RW_u \cdot CW.$$

It is possible, therefore, to determine exactly the amount of the coating material applied by each pressing roll to the web even when a certain amount of the coating material penetrates into the web and cannot be determined in a total measure to belong to either side. It is thus possible to generate a uniform longitudinal profile of the coated web 4 in that application to each side which is controlled and it is possible, therefore, to obtain uniform coatings on each side, especially in the case of application of pigments to the upper and lower side of the web.

We claim:

1. A process for two-sided coating of a web comprising the steps of:

(a) feeding said web through a nip of a pair of pressing rolls;

(b) metering onto each of said pressing rolls before the respective pressing roll meets said web, a controlled quantity of a coating substance, thereby transferring said substance to said web on a respective side thereof;

(c) measuring by infrared absorption a respective quantity of said coating substance on each of said rolls at a respective location of the roll upstream of the transfer of said substance to the web by the respective roll, thereby obtaining a value $M2_o$ for an absorption measurement on the roll applying said substance to an upperside of the web and a value $M2_u$ for an absorption measurement on the roll applying said substance to the underside of the web;

(d) determining values of a web upperside relative coating quantity $RW_o$ and a web underside relative coating quantity $RW_u$ based upon the relations:

$$RW_o = M2_o/(M2_o + M2_u) \text{ and}$$

$$RW_u = M2_u/(M2_o + M2_u); \text{ and}$$

(e) automatically controlling the application of said substance to each of said rolls in response to the respective values $RW_o$ and $RW_u$.

2. The process defined in claim 1, further comprising the steps of:

measuring a total quantity CW of said substance applied to said web by said rolls; and determining the amounts $CW_o$ and $CW_u$ applied to the upperside and the underside, respectively, of said web from the relations:

$$CW_o = RW_o \cdot CW \text{and}$$

$$CW_u = RW_u \cdot CW.$$

3. The process defined in claim 2 wherein said total quantity CW is measured by obtaining a difference in measurement of the weights per unit area of the web prior to and subsequent to coating.

4. The process defined in claim 2, further comprising the step of effecting an infrared absorption measurement of said substance remaining upon each roll downstream of the nip to establish with precision by a difference between infrared absorption measurements on each roll upstream and downstream of the nip, the amount of the substance transferred to the respective side of the web.

* * * * *